US005794605A

United States Patent [19]

Kato

[11] Patent Number: 5,794,605

[45] Date of Patent: Aug. 18, 1998

[54] FUEL CONTROL FOR MARINE ENGINE

[75] Inventor: Masahiko Kato, Hamamatsu, Japan

[73] Assignee: Sanshin Kogyo Kabushiki Kaisha, Hamamatsu, Japan

[21] Appl. No.: 611,148

[22] Filed: Mar. 5, 1996

[51] Int. Cl.[6] ..... F02D 41/14

[52] U.S. Cl. ..... 123/688; 123/65 R

[58] Field of Search ..... 123/65 R, 676, 123/688; 73/118.1

[56] References Cited

U.S. PATENT DOCUMENTS

| | | | |
|---|---|---|---|
| 4,373,187 | 2/1983 | Ishii et al. | 123/674 X |
| 4,434,764 | 3/1984 | Hasegawa et al. | 123/688 X |
| 4,980,834 | 12/1990 | Ikeda et al. | 123/688 X |
| 5,235,957 | 8/1993 | Furuya | 123/688 |
| 5,357,791 | 10/1994 | Gee et al. | 73/118.1 |
| 5,370,101 | 12/1994 | Hamburg et al. | 123/688 |
| 5,417,099 | 5/1995 | Ohuchi | 60/285 X |
| 5,423,203 | 6/1995 | Namiki et al. | 123/688 X |
| 5,522,370 | 6/1996 | Katoh et al. | 123/685 |

FOREIGN PATENT DOCUMENTS

| | | | |
|---|---|---|---|
| 63-268948 | 11/1988 | Japan | 123/688 |

*Primary Examiner*—Tony M. Argenbright

*Attorney, Agent, or Firm*—Knobbe, Martens, Olson & Bear LLP

[57] ABSTRACT

A feedback control system for controlling the fuel/air ratio of an engine. The system employs a fuel/air ratio or combustion condition sensor and includes a checking system for checking if the sensor is providing reliable data. This is determined by determining whether the output of the sensor changes when an adjustment in the amount of fuel supplied is made. If the sensor check indicates unreliable signals, then the system operates on an open control.

20 Claims, 3 Drawing Sheets

FUEL CONTROL FOR MARINE ENGINE

BACKGROUND OF THE INVENTION

This invention relates to a fuel control system for an internal combustion engine and more particularly to an improved feedback control system for a marine engine.

In the interest of maintaining good fuel economy and exhaust emission control various types of fuel control systems have been provided for internal combustion engines. The systems all have the purpose of maintaining the desired fuel/air ratio for given engine running conditions.

One particularly popular type of control system is of the so-called "feedback" type. With this type of system, a desired fuel/air ratio is determined based upon engine running conditions. A combustion condition sensor or other type of fuel/air ratio sensor is then employed so as to detect the actual fuel/air ratio in the engine. It should be noted that the desired ratio may not be truly indicative of the optimum ratio because other factors than those engine parameters on which the desired ratio is set may effect the optimum ratio. For example, with a marine engine where the exhaust is discharged under the water level for silencing purposes, the depth of submersion of the exhaust can change the effective back pressure on the engine. As the back pressure changes, the optimum fuel/air ratio will also change under many circumstances, particularly with two-cycle engines.

It is, therefore, a principle object of this invention to provide an improved feedback control system for an engine.

With feedback control systems, it should be obvious that the effectiveness of the system is very dependent upon the accuracy of the combustion condition sensor. As a result of this, if the output of the combustion condition sensor becomes nonrepresentative of actual conditions due to any of a variety of reasons, then the feedback control may become erratic and result in poor engine performance and poor fuel economy and exhaust emission control.

Although various systems have been proposed for determining when the sensor is operative or providing an inaccurate signal, these systems generally are only capable of recognizing when the sensor is operative under startup conditions.

That is, certain sensors of this type must reach an appropriate operating temperature before they are effective. Therefore, there have been proposed arrangements wherein the operability of the sensor has been determined upon initial startup and other forms of control have been employed during the time period before the sensor is not operative. However, these systems do not possess the ability to determine when the sensor becomes inoperative or inaccurate during normal engine running.

One type of sensor utilized to determine the air/fuel ratio is an oxygen ($O_2$) sensor. These sensors are provided in the exhaust system and from measuring the amount of oxygen in the exhaust can determine, under most operating conditions, the actual air/fuel ratio in the combustion chamber. Although these devices are generally quite effective, in some applications and under some circumstances, their output may not be dependable.

This is particularly true in conjunction with outboard motor applications and when a two-cycle, crankcase compression engine is utilized. The phenomenon may also exist with four-cycle engines but it is more likely to occur with two-cycle engines due to their scavenging system.

With marine propulsion systems, the exhaust gases are discharged generally through an underwater exhaust gas discharge. In conventional systems, the back pressure for given vehicle conditions can be readily determined and compensated for in the control system. However, since the depth and angle at which the underwater exhaust discharge of a marine propulsion system can vary, the back pressure can vary significantly while other conditions remain constant.

If the back pressure increases, the amount of scavenging of the engine decreases and the mixture may tend to appear to be richer than it actually is. On the other hand, if the back pressure falls significantly, then the scavenging will significantly improve and it may appear that the mixture is leaner than it actually is. As a result, the output from the oxygen sensor may, at times when back pressure is significantly outside the normal ranges, not be indicative of engine operation. Thus, during these conditions feedback control may be inaccurate or unreliable.

It is, therefore, a principle object of this invention to provide an improved arrangement for determining the state of the sensor for the feedback control and resorting to other controls when the sensor is determined to be not fully operative or not representative of the actual engine conditions.

It is a further object of this invention to provide an improved control method for an engine employing a sensor and an arrangement for detecting errors in the sensor operation or output.

SUMMARY OF THE INVENTION

This invention is adapted to be embodied in the feedback control system and method for an internal combustion engine. The engine has a combustion chamber and a fuel/air supply system for delivering a fuel air charge to the combustion chamber. A combustion condition sensor is provided for determining the delivered fuel/air ratio by the fuel/air supply system. A feedback control system receives a signal from the combustion condition sensor and controls the fuel/air supply system to maintain the desired fuel/air ratio.

An apparatus for practicing the invention includes a detector for detecting an abnormal condition in the sensor output when a change in the fuel/air ratio demanded by the feedback control system does not change the output of the sensor after the change has been effected.

In accordance with a method for practicing the invention, the output of the sensor is detected when a change in the fuel/air ratio is demanded by the feedback control system in response to the output of the sensors. If the sensor output does not change during the time when the fuel/air supply system is adjusted, then the sensor output is determined to be unreliable.

DETAILED DESCRIPTION OF THE PREFERRED EMBODIMENT OF THE INVENTION

Figure 1:
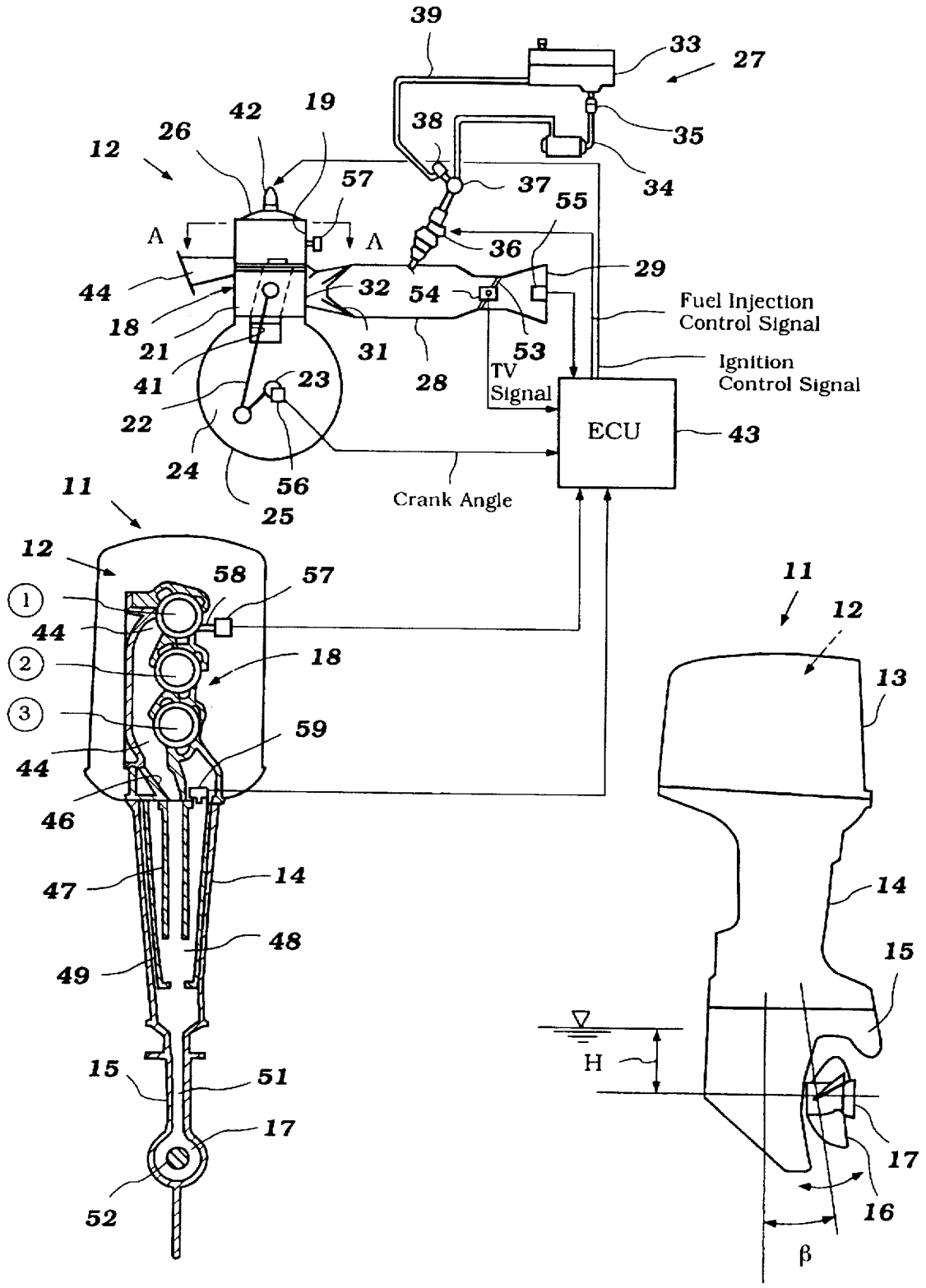
FIG. 1 is a composite view of three figures showing, (1) in the lower right-hand side, a side elevational view of an outboard motor constructed in accordance with an embodiment of the invention; (2) in the lower left-hand side, a cross-sectional view of the outboard motor taken along the line A—A of the upper view and looking generally at the rear of the outboard motor; and (3) in the upper view a partially schematic cross-sectional view taken through a single cylinder of the engine.

Referring now in detail to the drawings and initially to FIG. 1, an outboard motor constructed and operated in accordance with an embodiment of the invention is identified generally by the reference numeral 11. The outboard motor 11 is chosen as an illustrative embodiment of a construction wherein the invention has particular utility. This is in part because outboard motors normally, as with other marine propulsion units, discharge their exhaust gases beneath the level of water in which the watercraft is operating. Since this effective depth of discharge can vary, as will become described, the back pressure on the engine varies and hence the optimum fuel/air ratio also varies. Furthermore the effect of these changes on the feedback sensor also becomes significant, as will be apparent. This is particularly true with, but not limited to, two-cycle crankcase compression engines as are normally used with outboard motors.

The outboard motor 11 is shown in side elevational view in the lower right-hand view and includes a power head that is comprised of a powering internal combustion engine, indicated generally by the reference numeral 12 and which is surrounded by a protective cowling 14.

As will become apparent, the engine 12 is mounted so that its output or crankshaft rotates about a vertically extending axis. This is common practice in outboard motors so as to facilitate coupling of the engine output shaft to a drive shaft (not shown) which is journaled about a vertically extending axis within a drive shaft housing 14 disposed at the lower end of the power head. By having the engine output shaft also rotate about a vertically extending axis, the use of transmissions or other mechanisms for converting horizontal rotation to vertical rotation are eliminated.

The drive shaft which depends through the drive shaft housing 14 terminates in a lower unit 15 where a known type of transmission (not shown) drives a propeller 16 in selected forward and reverse directions.

Not shown in this figure but as is typical with outboard motor practice, the outboard motor 11 is mounted for steering movement about a generally vertically extending steering axis and for tilt and trim movement about a generally horizontally extending trim axis. This tilt and trim movement permits trim adjustment of the propeller 12 and its angle of attack through a range as indicated by the angle β in FIG. 1.

As is typical in outboard motor and other marine propulsion practice, the exhaust gases from the engine 12 are discharged, in a manner which will be described, through an underwater exhaust discharge, most typically formed in the hub 17 of the propeller. As a result of the trim adjustment through the angle β, the depth of the exhaust gas discharge below the water level as indicated by the dimension H will vary with the trim angle. In addition, the direction of the exhaust gas discharge also will vary from downwardly facing to upwardly facing. Because of this, the back pressure on the engine can vary significantly as the trim angle is adjusted.

Referring now primarily to the left-hand lower and upper views in this figure, the engine 12 is depicted as being of the three cylinder in-line type. Although the invention is described in conjunction with such an arrangement, it will be readily apparent to those skilled in the art how the invention can be practiced with engines having other cylinder numbers and other cylinder configurations. Also, the engine 12 operates on a two-cycle crankcase compression principle. Again, however, it will be readily apparent to those skilled in the art how the invention can be employed with engines operating on four-stroke principles.

Since the actual internal details of the engine 12 form no significant portion of the invention, the engine 12 has been depicted generally in schematic form and will be described only generally. Those skilled in the art can readily refer to any known prior art type of constructions for examples of engines with which the engine may be practiced.

The engine 12 includes a cylinder block 18 in which three horizontally disposed cylinder bores are formed. The cylinder bores are indicated by the reference numeral 19 and are vertically spaced from each other so as to provide the in-line construction as aforenoted. The cylinders are numbered 1, 2, and 3 beginning at the uppermost end as shown by the reference characters in the lower left-hand view of FIG. 1.

Pistons 1 reciprocate in each of the cylinder bores 19 and are connected by means of connecting rods 22 to a crankshaft 23. The crankshaft 23 rotates, as aforenoted, about a vertically extending axis within a crankcase chamber 24 formed by a crankcase member 25 that is affixed to the cylinder block 18 and by the skirt of the cylinder block 18. As is typical with two-cycle crankcase compression engines, the crankcase chambers 22 associated with each of the cylinder bores 19 are sealed from each other in any suitable manner.

A cylinder head 26 is affixed to the cylinder block 18 on the side opposite the crankcase member 25. The cylinder head 26 has individual recesses which cooperate with the cylinder bores 19 and pistons 21 to form the individual combustion chambers of the engine.

A fuel and air charge forming system, indicated generally by the reference numeral 27, is provided for delivering a fuel/air charge to these combustion chambers. This system includes an air intake manifold 28 which is shown schematically and which has an atmospheric air opening 29 that receives atmospheric air from within the protective cowling 13. As is well known in this art, the protective cowling 13 is provided with a suitable atmospheric air inlet to permit air to enter its interior for engine operation.

The intake manifold 28 has a plurality of individual runners, one for each crankcase chamber 24 in which reed-type check valves 31 are provided. The reed-type check valves 31 permit air and fuel, as will become apparent, to enter the crankcase chambers 24 through adjacent intake ports 32 when the pistons 21 are moving upwardly in the cylinder bores 19 and the volume of the crankcase chamber 24 is increasing. However, as the pistons 1a move downwardly, the check valves 31 will close and permit the charge to be compressed in the crankcase chambers 24.

In addition to the air as thus far described, fuel is also mixed by the system 27 with the air charge inducted into the crankcase chambers 24. The illustrated embodiment depicts a manifold-type injection system for this purpose. It will be readily apparent to those skilled in the art, however, that this invention may be employed in conjunction with engines having other types of fuel supply systems including direct cylinder injection.

The fuel supply system includes a remotely positioned fuel tank 33 from which fuel is drawn by means of a pump 34 through a filter 35. This fuel is then delivered to individual fuel injectors 36 each of which sprays into a respective one of the runners of the intake manifold 28. A fuel rail 37 connects the fuel supply system to the injectors 36 in a well known manner.

A pressure control valve 38 is provided in the fuel rail 37 and regulates the pressure of the fuel supplied to the injectors 36 by dumping excess fuel back to the fuel tank 33 or some other position in the fuel supply system through a return conduit 39.

Thus, because of the manifold injection system described, a fuel/air mixture is introduced into the crankcase chambers 24 and is compressed, as aforenoted. The compressed charge is then transferred to the combustion chambers through one or more scavenge passages 41. This charge is then further compressed in the combustion chamber and is fired by means of spark plugs 42.

The spark plugs 42 are fired by an ignition system under the control of an ECU, indicated generally by the reference numeral 43. The ECU 43 also controls the timing and duration of fuel injection from the injectors 36. It should be noted that the injectors 36 illustrated are of the electrically operated, solenoid type although other types of injectors may also be employed.

As the spark plugs 42 fire, the fuel/air charge in the combustion chambers will burn and expand to drive the pistons 21 downwardly and drive the crankshaft 23 as is well known in this art.

The exhaust gases from combustion are discharged through an exhaust system to the aforenoted underwater exhaust discharge in a manner which will now be described. Each cylinder bore 19 is provided with a respective exhaust port 44 which exhaust ports 44 communicate with an exhaust manifold 45 that is formed in part integrally within the cylinder block 18, as is also typical with outboard motor practice. This exhaust manifold 45 terminates in a downwardly facing discharge opening 46 which communicates with the upper end of an exhaust pipe 47. The exhaust pipe 47 discharges into an expansion chamber 48 formed by an inner shell 49 of the drive shaft housing 14 for silencing purposes. The exhaust gases then flow downwardly through an exhaust passage 51 formed in the lower unit 15 for discharge through the hub discharge port 17 around a propeller shaft 52 which drives the propeller 16, as aforenoted.

As has been noted, the ECU 43 operates so as to control not only the timing of the firing of the spark plugs 42 but also the timing and duration of fuel injection from the fuel injectors 36. For this purpose, the ECU receives certain signals from engine operating and ambient conditions. Only certain of those signals will be described because it is believed within the scope of those skilled in the art to understand that various types of control strategies may be employed. The invention deals primarily with the feedback control system which is employed and specifically a manner in which the reliability of it is determined. This system will be described in more detail later by reference to FIG. 2 but certain of the sensors for the control system are illustrated and will be described by reference to FIG. 1.

In order to control the speed of the engine 12 there is provided a throttle valve 53 which is interposed in the air inlet 29 of the induction and charge forming system 27 for controlling the air flow to the engine. A throttle position sensor 54 is associated with the throttle valve 53 and outputs a throttle valve position signal to the ECU 43. This signal is in essence a load demand signal on the engine. In addition, an air flow sensor 55 is mounted in the atmospheric air inlet opening 29 so as to provide a signal representative of the amount of intake air to the ECU 53.

A crank angle sensor 56 is associated with the crankshaft 23 and outputs a crank angle signal to the ECU 43. This crank angle signal permits the ECU 43 to determine the angular position of the crankshaft for timing of the firing of the spark plugs 42 and for injection of fuel from the injectors 36. Also by counting the number of pulses generated by the sensor 56 in a given time period, the engine speed may also be calculated.

The system further includes, as has been noted, a feedback control system and therefore a combustion condition sensor indicated by the reference numeral 57 is provided. In the illustrated embodiment, the combustion condition sensor 57 constitutes an oxygen ($O_2$) sensor which communicates with the exhaust port of one of the cylinders through a sensing port 58. The oxygen sensor outputs a signal indicative of the density of the oxygen in the exhaust gases. As is well known, this signal can be utilized to determine the actual fuel/air ratio in the engine. More specifically, it may be utilized to determine if the fuel/air ratio is stoichiometric, i.e., $\lambda=1$.

As has been noted, the desired fuel/air ratio also will depend upon exhaust back pressure and this is measured by a back pressure sensor 58 that communicates with the expansion chamber 48 to provide a back pressure signal to the ECU 43. Other factors which effect back pressure such as trim angle, etc., may also be supplied. As has been previously noted, still further ambient and engine running conditions may be utilized in the overall fuel/air ratio control for the engine.

The basic components of the ECU 43 that are employed in the fuel injection control for controlling the amount of fuel injected by the fuel injector 36 will now be described by reference to FIG. 2. Basically, the system operates so that under conditions when the output of the oxygen sensor 57 is determined to be normal, the system operates under a feedback control system. However, in the event the sensor is determined to be inoperative or fails to give a representative of an actual air/fuel ratio, then the system goes to an open control wherein the air/fuel ratio is set purely by engine running and ambient conditions.

Figure 2:
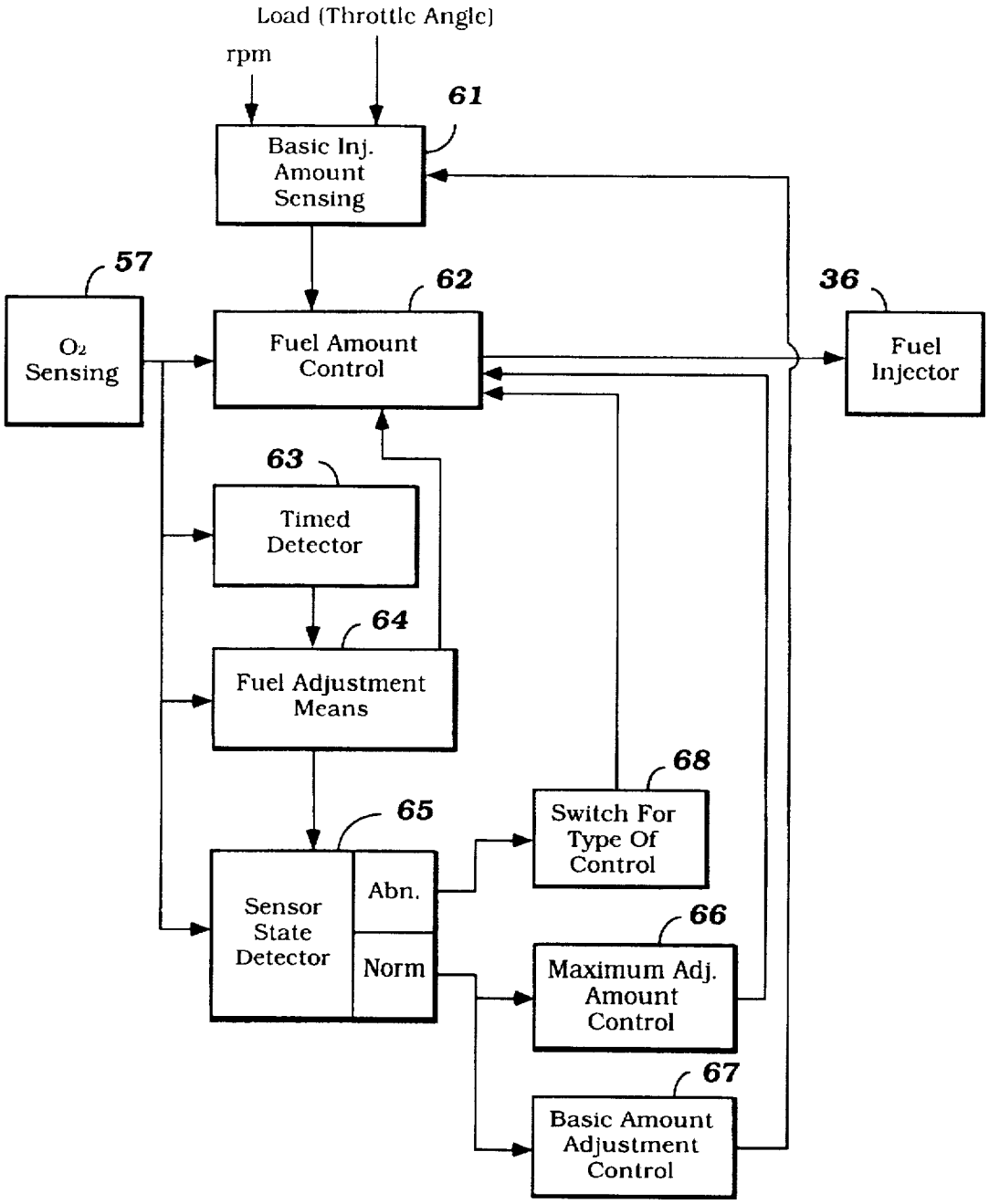
FIG. 2 is a block diagram showing the various components of the control system and their interrelationship.

As seen in FIG. 2, the engine speed, which as has been noted can be determined by measuring the number of pulses from the crank angle sensor 56 in a given time period. The load is indicated by throttle valve position measured by the throttle position sensor 54. These signals are transmitted to a basic fuel injection amount setting device or system, shown schematically at 61. This setting device is comprised of a map or maps that provide basic fuel injection amount for these parameters and independent of anything else.

This map result is then outputted to a fuel amount control circuit or system 62 which provides a controlling signal to the fuel injector 36 as shown in this figure. This control determines both the timing of the beginning of injection and the duration of injection.

The oxygen sensor 57 outputs its signal to the fuel amount control system 62. In addition, it outputs the signal to a timer detector 63, a fuel adjustment means 64 and a sensor state detector 65. The outputs from the timer detector 63 also goes to the fuel adjustment means 64 and these signals go to the sensor state detector 65.

The sensor safe detector 65 determines whether the sensor 57 is operating properly or improperly and thus makes a determination so as to operate in a normal mode in which the maximum adjustment amount of feedback control is set by an appropriate system 66 and the basic injection amount control is set by a control section 67. If, however, abnormal conditions are sensed by the sensor 65, then it actuates a switch 68 which outputs a signal to the fuel amount control 62 so as to revert to an open control.

The oxygen sensor 57 will output the signal of the air/fuel ratio as determined by measuring the oxygen content in the exhaust gases, as previously noted. Under normal engine operating conditions when back pressure is in a normal range, the oxygen sensor 57 will provide a very accurate signal and feedback control is possible. However, if the outboard motor 11 is trimmed down significantly, then the underwater exhaust gas discharge 17 will be at a low level. In addition, because of the pivotal movement of the outboard motor 11, the discharge 17 will face in a more downward direction and hence the path of flow of exhaust gases to the water level V will be long and exhaust back pressure will be high.

Under conditions of high exhaust back pressure, the scavenging of the engine will not be as complete and, therefore, the exhaust charge will tend to indicate a richer than normal condition. When this occurs, the feedback control signals are not appropriate for determining the actual air/fuel ratio that has been set.

On the other hand, when the outboard motor 11 is trimmed up, the depth of the exhaust discharge 17 will be relatively shallow. In addition, because of the pivotal movement, it will be directed upwardly and exhaust back pressure will be lower than normal. When this occurs, the scavenging will significantly improve and there will be a high oxygen content in the exhaust gases and this will indicate a lean mixture. Again, this is not truly indicative of the proper conditions for control. Therefore, the ECU 43 provides a control strategy, as will be described, so as to determine when the sensor output is believed to be not indicative of actual conditions and, accordingly, the system reverts to an open control.

Basically, the way the system operates is that when a change in mixture strength is called for and the adjustment is made, the output of the oxygen sensor is monitored to determine if it varies. Thus, if the fuel/air ratio is either indicated to be on the lean side of stoichiometric or on the rich side of stoichiometric, a correction is necessary and the output, in addition to being transmitted to the fuel amount control 62 will be outputted, as noted, to the timer detector 63 and to the fuel adjustment means 64, as well as to the sensor state detector 65.

Assuming that a lean or rich mixture is indicated, then the fuel adjustment means 64 will call for the fuel amount control 62 to make a change in the amount of fuel supplied by the fuel injector 36 to bring the ratio back to the desired ratio. The timer 63 waits a time period to determine if the output of the sensor 57 has been changed after this adjustment is made. If the change in the adjustment results in no change of the sensor output 57, then the sensor state detector 65 determines that the sensor 57 is unreliable.

Under this condition, the sensor state detector abnormal circuit portion outputs a signal to the switch 68 so as to signal the fuel amount control 62 to discontinue feedback control and move to an open control state. Under this open control state, the fuel/air ratio is controlled only by the basic injection amount circuit 61 and its inputs. In the illustrated embodiment, this is speed and load but, as noted above, this may be varied depending upon the actual conditions.

Figure 3:
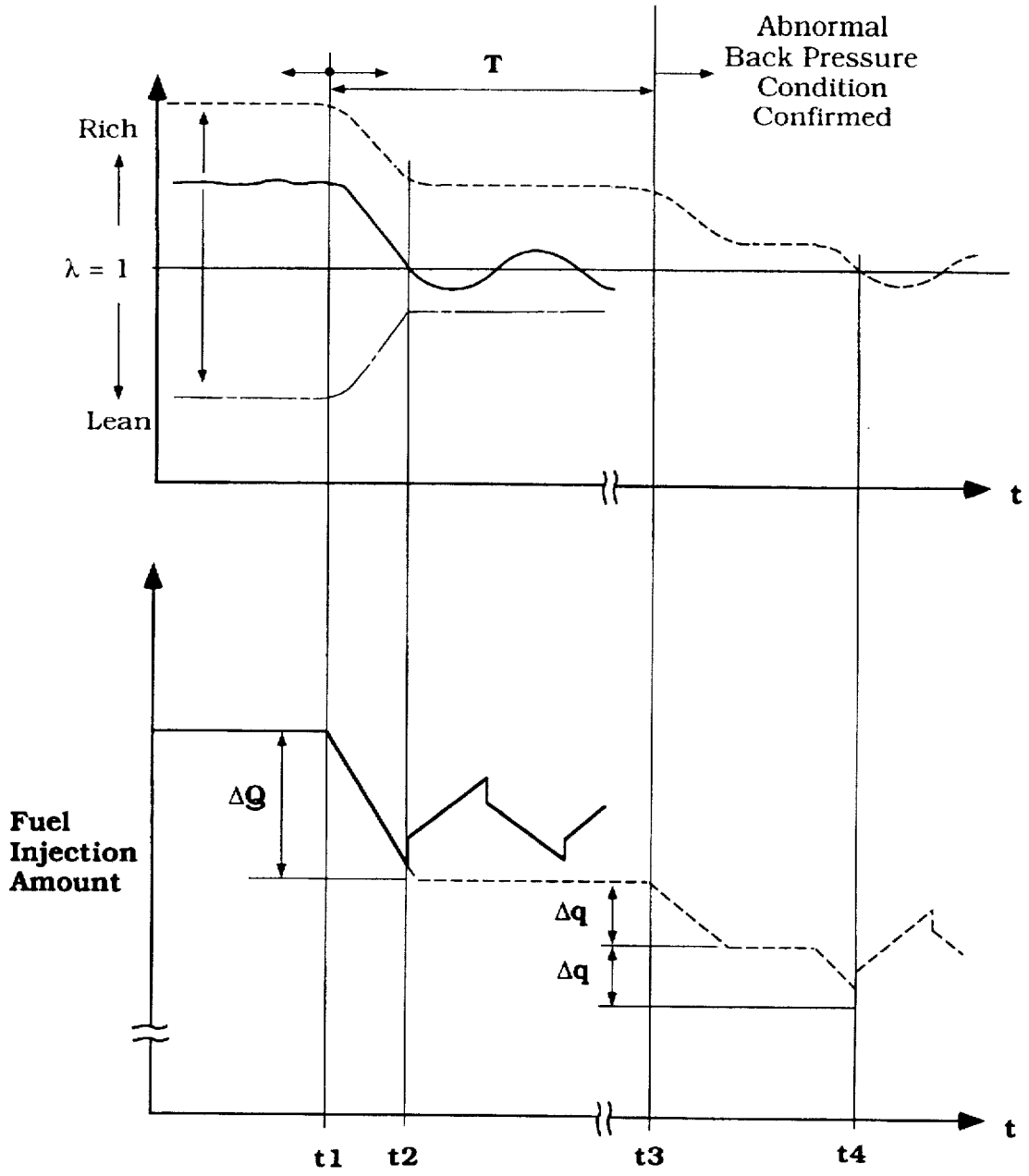
FIG. 3 is a graphical view showing the air/fuel ratio sensor output, a normal output and normal and corrected fuel injection amounts during a control cycle in relation to the elapsed time.

Referring now to FIG. 3, the solid line curves show the output of the oxygen sensor and the fuel injection amount in solid line curves for normal operating conditions. The transition from an open control at startup to a feedback control is also illustrated.

Considering first the normal conditions when exhaust back pressure is in the normal range the sensor output will be truly indicative of air/fuel ratio. As may be seen, the normal startup open control provides a richer than normal mixture. After the time period ti is reached, the system is determined to be stabilized and the oxygen sensor 57 is at its operating temperature.

The system then switches to feedback control. Since the mixture is determined to be rich, the feedback control circuit causes an immediate reduction of the amount of fuel injected by decreasing it by the amount $\Delta Q$. If this amount brings the mixture to the stoichiometric ratio, then the sensor output 57 will so indicate and the air/fuel ratio is maintained. However, there will be some hunting and the mixture will then go lean. This then causes the fuel injection amount to be increased along with any desired strategy and this condition will be maintained.

On the other hand, if a situation exists where there is an abnormal or high exhaust gas back pressure, then the sensor output will indicate, as shown by the broken line curve, a rich mixture. This rich mixture will actually be richer than the normal mixture. Thus, upon transition to the feedback control, the system will call for a reduction in the fuel injection amount and the fuel injection amount is again decreased by the amount $\Delta Q$. When this occurs, as seen by the broken line curve, the fuel/air ratio indicated by the sensor 57 will still be on the rich side and this is noted in the area A indicated in FIG. 3. This occurs at about the time t2 when the mixture indicated by the oxygen sensor 57 would be normally stoichiometric.

In this regard, it should be noted that the actual output of the sensor may just be an on/off signal as is typical with this type of sensor. Hence, as long as $\lambda$ is greater than 1, the mixture will either output a signal or not output a signal depending upon its exact type.

In accordance with the control strategy, the timer detector 63 is begun to run at the time t1. At the time when the fuel injection amount is decreased, the program then waits for a time period before another adjustment is made. This time period may be the total time period T between t1 and t3. Hence, rather than following the solid line fuel injection amount shown in FIG. 3, it follows the broken line condition A'. At the time t3 if the output of the sensor 57 has not been changed, then the program reverts to an open control procedure.

Under this open control procedure, the amount of fuel injected is decreased by an amount $\Delta q$ and the sensor output is again read. This then moves into the domain indicated at B and B' in FIG. 3. If the result indicates that the output of the sensor is still not changed or stoichiometric, then another decrease in the amount $\Delta q$ is begun.

If now at the time t4 the oxygen sensor 57 outputs a signal indicative of stoichiometric, the system then reverts back to the feedback control since the oxygen sensor is now reliable because for some reason the back pressure condition has changed or the open control has resulted in the return to normal conditions.

The same type of strategy is also employed for correction in the event the mixture is indicated at lean on startup as indicated by the dot/dash curve.

Thus, from the foregoing description should be readily apparent that the described system provides a very effective way for determining if the sensor of the system is representative of actual conditions. If it is, then the maximum adjustment amount and basic injection amount adjustment are controlled by the feedback control. If, however, the feedback control sensor is determined to be abnormal or unreliable, then the system reverts to an open control.

Those skilled in the art will readily understand that the foregoing description is that of a preferred embodiments of the invention and that various changes and modifications may be made without departing from the spirit and scope of the invention, as defined by the appended claims.

What is claimed is:

1. A feedback control system for an internal combustion engine having a combustion chamber, a fuel and air supply system for delivering a fuel and air charge to said combustion chamber, an exhaust discharge that discharges the exhaust gases in a condition wherein the back pressure may vary, a combustion condition sensor for determining the fuel/air ratio supplied by said fuel and air supply system to said combustion chamber, a feedback control system for receiving signals from said combustion condition sensor and controlling said fuel/air supply system to maintain the desired fuel/air ratio, and detecting means for detecting an abnormal condition in the event a change in the fuel/air ratio is demanded by the feedback control system and the fuel/air ratio signal does not change within a predetermined time after the ratio change is effected, said abnormal condition of said combustion condition sensor being caused by abnormal exhaust back pressure.

2. A feedback control system for an internal combustion engine as set forth in claim 1, wherein the feedback control system provides a basic fuel/air ratio amount in response to sensed engine parameters and this amount is adjusted in response to the output of the combustion condition detector.

3. A feedback control system for an internal combustion engine as set forth in claim 2, wherein the event of sensing of an abnormal condition, the system reverts to an open control wherein the basic fuel/air ratio control setting is employed for setting the amount of the air/fuel ratio.

4. A feedback control system for an internal combustion engine as set forth in claim 1, wherein the fuel/air supply system includes a fuel injector and the feedback control controls the amount of fuel supplied by the fuel injector to control the air/fuel ratio.

5. A feedback control system for an internal combustion engine as set forth in claim 4, wherein the feedback control system provides a basic fuel/air ratio amount in response to sensed engine parameters and this amount is adjusted in response to the output of the combustion condition detector.

6. A feedback control system for an internal combustion engine as set forth in claim 5, wherein the event of sensing of an abnormal condition, the system reverts to an open control wherein the basic fuel/air ratio control setting is employed for setting the amount of the air/fuel ratio.

7. A feedback control system for an internal combustion engine as set forth in claim 1, wherein the engine is employed with a marine propulsion system and the exhaust gases are discharged through an underwater exhaust gas discharge.

8. A feedback control system for an internal combustion engine as set forth in claim 1, wherein the engine is a two cycle crankcase compression engine.

9. A feedback control system for an internal combustion engine as set forth in claim 7, wherein the engine is employed with a marine propulsion system and the exhaust gases are discharged through an underwater exhaust gas discharge.

10. A feedback control system for an internal combustion engine as set forth in claim 9, wherein the combustion condition sensor is in the exhaust flow path from the combustion chamber.

11. A control method for an internal combustion engine having a combustion chamber, a fuel and air supply system for delivering a fuel and air charge to said combustion chamber, an exhaust discharge that discharges the exhaust gases in a condition wherein the back pressure may vary, a combustion condition sensor for determining the fuel/air ratio supplied by said fuel and air supply system to said combustion chamber, a feedback control system for receiving signals from said combustion condition sensor and controlling said fuel/air supply system to maintain the desired fuel/air ratio, said method comprising the steps of detecting an abnormal condition in the event a change in the fuel/air ratio is demanded by the feedback control system and the fuel/air ratio signal does not change within a predetermined time after the ratio change is effected and the abnormal condition of the combustion condition sensor is caused by abnormal exhaust back pressure.

12. A control method for an internal combustion engine as set forth in claim 11, wherein the feedback control provides a basic fuel/air ratio amount in response to sensed engine parameters and this amount is adjusted in response to the output of the combustion condition detector.

13. A control method for an internal combustion engine as set forth in claim 12, wherein the event of sensing of an abnormal condition, an open control is applied wherein the basic fuel/air ratio control setting is employed for setting the amount of the air/fuel ratio.

14. A control method for an internal combustion engine as set forth in claim 11, wherein the fuel/air supply system includes a fuel injector and the amount of fuel supplied by the fuel injector is varied to control the air/fuel ratio.

15. A control method for an internal combustion engine as set forth in claim 14, wherein the feedback control provides a basic fuel/air ratio amount in response to sensed engine parameters and this amount is adjusted in response to the output of the combustion condition detector.

16. A control method for an internal combustion engine as set forth in claim 15, wherein the event of sensing of an abnormal condition, an open control is applied wherein the basic fuel/air ratio control setting is employed for setting the amount of the air/fuel ratio.

17. A control method for an internal combustion engine as set forth in claim 11, wherein the engine is employed with a marine propulsion system and the exhaust gases are discharged through an underwater exhaust gas discharge.

18. A control method for an internal combustion engine as set forth in claim 16, wherein the engine is a two cycle crankcase compression engine.

19. A control method for an internal combustion engine as set forth in claim 18, wherein the engine is employed with a marine propulsion system and the exhaust gases are discharged through an underwater exhaust gas discharge.

20. A control method for an internal combustion engine as set forth in claim 19, wherein the combustion condition sensor is in the exhaust flow path from the combustion chamber.

* * * * *

UNITED STATES PATENT AND TRADEMARK OFFICE

CERTIFICATE OF CORRECTION

PATENT NO. : 5,794,605
DATED : August 18, 1998
INVENTOR(S) : Kato

It is certified that error appears in the above-identified patent and that said Letters Patent is hereby corrected as shown below:

On the title page, insert the following item -- [30] Foreign Application Priority Data
Mar. 7, 1995 [JP] ..... 7-46901--

Signed and Sealed this

Thirteenth Day of April, 1999

*Attest:*

Q. TODD DICKINSON

*Attesting Officer*

*Acting Commissioner of Patents and Trademarks*